United States Patent [19]

Holt

[11] Patent Number: 4,715,126

[45] Date of Patent: Dec. 29, 1987

[54] ARCHERY BOW SIGHT

[76] Inventor: Terry Holt, 2181 Broadmore Ave., San Pablo, Calif. 94806

[21] Appl. No.: 1,231

[22] Filed: Jan. 7, 1987

[51] Int. Cl.[4] ..... F41G 1/46

[52] U.S. Cl. ..... 33/265

[58] Field of Search ..... 33/265; 124/87, 25

[56] References Cited

U.S. PATENT DOCUMENTS

| | | | |
|---|---|---|---|
| 3,355,809 | 12/1967 | Guyton | 33/265 |
| 3,822,479 | 7/1974 | Kowalski | 33/265 |
| 3,854,217 | 12/1974 | Killian | 33/265 |
| 4,026,032 | 5/1977 | Smith | 33/265 |
| 4,567,668 | 2/1986 | King et al. | 33/265 |
| 4,625,421 | 12/1986 | Strauss | 33/265 |

*Primary Examiner*—Harry N. Haroian

*Attorney, Agent, or Firm*—Mallinckrodt & Mallinckrodt

[57] ABSTRACT

An archery bow sight having a plurality of sighting pins for setting range includes a plurality of pin receiving and holding blocks mounted in a mounting block that defines a path of travel for such receiving and holding blocks. The sighting pins are received and held by the receiving and holding blocks and move with them. Apparatus such as a threaded shaft and thumbscrew arangement is manually operated to move individual receiving and holding blocks along their paths of travel and to hold such blocks in position whenever operation of the respective moving apparatus is stopped. In this way, individual receiving blocks and sighting pins received therein are held in position unless positively moved by operation of respective moving apparatus.

9 Claims, 4 Drawing Figures

ARCHERY BOW SIGHT

BACKGROUND OF THE INVENTION

1. Field

The invention is in the field archery bow sights.

2. State of the Art

There are numerous types of sights that have been developed for use with archery bows. Many of these sights provide for both range settings and windage settings.

Normally an archer will make the range adjustment of his sight by trial and error on a traget and then lock the range adjustment. The windage adjustments will be made in the field according to the environmental conditions present at the time. It is, of course, extremely important that the act of making the windage adjustments does not disturb the prior range adjustments.

Various sights, such as those shown in U.S. Pat. Nos. 3,355,809 and 3,854,217 have a sighting member which can be moved up and down a track such as a rack by rotation of a screw member. Markings may be placed on the track so that the sight member may be moved to the appropriate position for a desired range. This, however, requires adjustment each time the range changes which can make use of such sights difficult when hunting.

A number of sights have been developed which use a plurality of sighting pins which are adjusted and secured in position in the sight at locations set for different distances. This range or distance adjustment is generally made by moving the pins in the plane of the bow which is a vertical plane when the bow is held in normal shooting position. Thus, the vertical position of a sighting pin is adjusted to represent a certain range. Generally there will be a plurality of pins, each having a differently colored tip, each of which is set for a different range. In use, a hunter estimates the range or distance of the target in the field and then uses the appropriately colored pin or sights between the appropriate colored pins for the estimated distance in aiming the bow. Such a sight may be quickly and accurately used over a wide range of distances without having to be readjusted. Usually the pins are also adjustable in the field for windage. This adjustment involves the horizontal movement of the pins with respect to the bow in shooting position, i.e. movement in a direction transverse to the plane of the bow. In some sights of this type, adjustment of windage in the field involves loosening the pin followed by the horizontal adjustment. During this adjustment, the archer has to be very careful so that the pin does not move vertically and lose the range adjustment.

U.S. Pat. No. 4,026,032 shows an archery sight of the pin type wherein provision is made to keep the vertical or range adjustment secure while windage adjustments to the individual pins are made.

In addition to holding the range adjustment secure during windage adjustment, it would also be desirable to hold the pins in their range adjustment during range adjustment so that when a pin is loosened in order to be moved vertically, it will remain in its vertical position until the archer takes positive action to adjust the vertical position. With prior art sights of the pin type, such as that shown in U.S. Pat. No. 4,026,032, when the pin is loosened for vertical movement, it is free to slide up and down in its adjustment slot and if not held securely and moved accurately by the archer and then again locked in position while being securely held, it can easily slide out of adjustment.

SUMMARY OF THE INVENTION

According to the invention, an archery bow sight having a plurality of pins therein for setting range includes a plurality of pin receiving and holding means, each pin receiving and holding means being adapted to receive and hold an individual pin, a mounting block defining a path of travel for the pin receiving and holding means, and manually operated means for individually moving the pin receiving and holding means back-and-forth along the path of travel and for maintaining the position of the individual receiving and holding means at any position along the path of travel when operation of the means for moving ceases. In this way, the pin receiving and holding means maintains its position along the path of travel unless manually moved by the archer and will remain in any position to which it is moved unless further moved by the adjustment means. Thus, the pins cannot move unless the archer takes positive action to move them.

In a preferred embodiment of the invention, the mounting block has a groove therein which receives the plurality of individual pin receiving and holding means, the groove defining the path of travel for such means. A threaded shaft passes longitudinally through the groove and freely through each of the pin receiving and holding means. A thumbscrew is mounted in each pin receiving and holding means and is threaded onto the shaft so that rotation of the thumbscrew causes movement of the thumbscrew and pin recieving and holding means longitudinally along the shaft within the groove.

Each pin receiving and holding means has a threaded hole therein to receive a pin therethrough in transverse orientation to the plane of the bow on which the sight may be mounted. Rotation of the pin will move the pin horizontally for windage adjustment. It is preferred that the pins extend through a slot in the mounting block and have a collar thereon which can be tightened against the mounting block to lock the pins in their adjusted positions to ensure that they are not accidentally moved.

THE DRAWINGS

The best mode presently contemplated for carrying out the invention is illustrated in the accompanying drawings in which:

FIG. 1 is a perspective view of a bow sight of the invention mounted on an archery bow which is shown fragmentarily;

FIG. 2, a side elevation taken on the line 2—2 of FIG. 1 showing the sight removed from the bow:

FIG. 3, a fragmentary horizontal section taken on the line 3—3 of FIG. 2 and drawn to a larger scale; and FIG. 4, a fragmentary vertical section taken on the line 4—4 of FIG. 3.

DETAILED DESCRIPTION OF THE ILLUSTRATED EMBODIMENT

Figure 1:
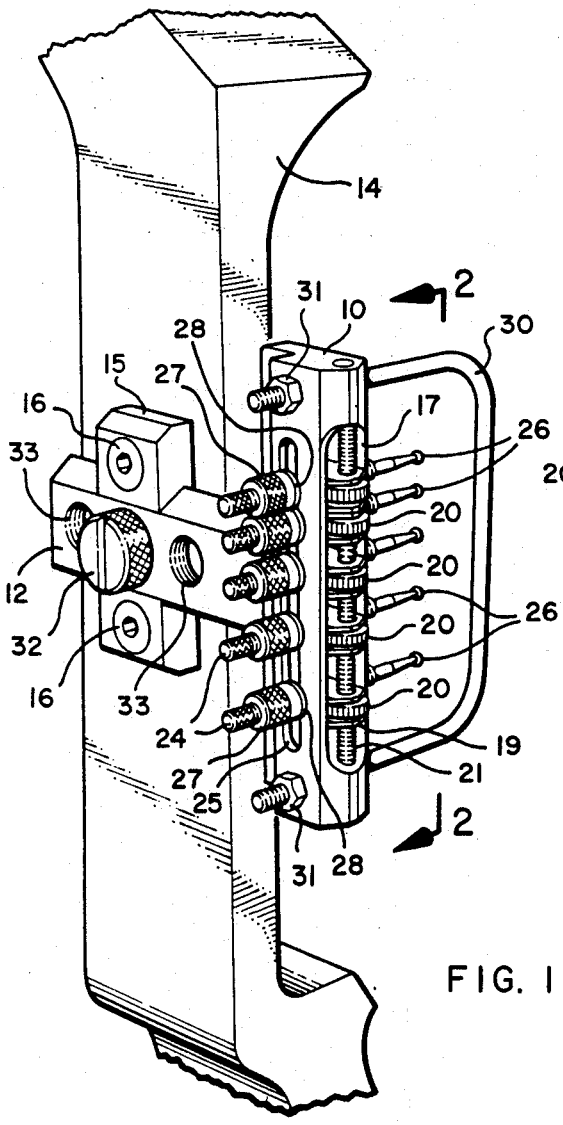
Figure 2:
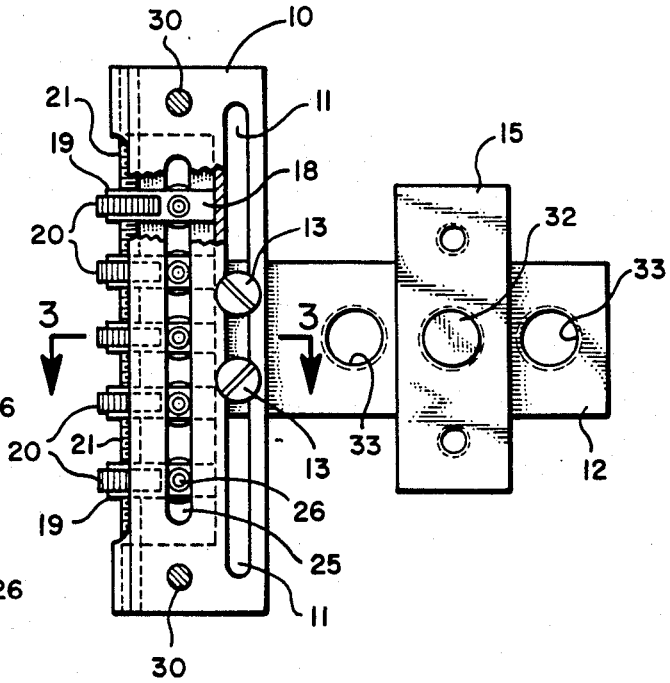
Figure 4:
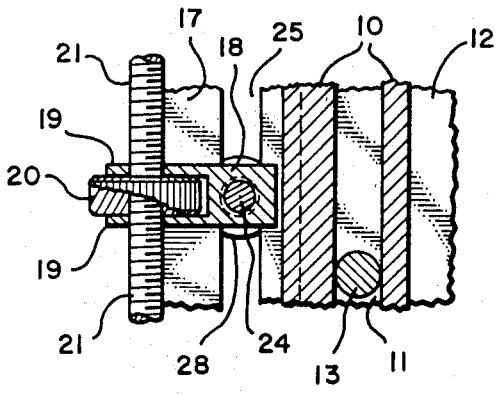

As illustrated in the drawings, the archery bow sight of the invention includes a mounting block 10, secured for movement along slot 11 to a base member 12 such as by screws 13. Base member 12 is secured to the handle section 14 of an archery bow by bracket 15 secured to bow handle 14 in normal manner by screws 16 in sight mounting holes usually provided in the handle section of most archery bows. As shown in FIG. 1, when in shooting position, the bow is held in a generally vertical position, i.e., the plane of the bow is vertical. With such orientation, mounting block 10 is also in a generally vertical position as shown in FIGS. 1 and 2. As used herein, vertical and horizontal will be in relation to the orientation as shown in FIGS. 1 and 2.

Mounting block 10 has formed therein a groove 17 which receives a plurality of sighting pin receiving and holding means such as pin receiving blocks 18 which closely fit into groove 17 for sliding movement therein. The fit should be as close as possible but still allow free sliding movement of the blocks 18 within the groove 17. Generally, the closer the fit, the better.

Each pin receiving block 18 has two parallel flat-faced ears 19 extending therefrom. The flat faces are spaced to accept a thumbwheel 20 with its axis perpendicular to the flat faces. The thickness of the thumbwheel 20 is slightly less than the spacing between the flat faces so that it will fit snugly, but not tightly, in the space.

The diameter of the thumbwheel is such that its center preferably lies within the periphery of the flanges 19 but its circumferential edge away from receiving block 18 will extend beyong the ears 19 as shown. A threaded shaft 21 extends longitudinally through groove 17 and through holes 22 in ears 19. Shaft 21 is secured in block 10 on either end of groove 17. Each thumbwheel 20 has a threaded axial bore which mates with sahft 21. Thus, rotation of a thumbwheel 20 causes that thumbwheel 20 to move longitudinally along shaft 21, the direction of rotation determining the direction of travel. The external periphery of each thumbwheel is preferably knurled to facilitate rotation by a thumb or finger of an archer.

In the embodiment shown there are five pin receiving blocks 18. Each block 18 has a threaded bore 23 therethrough to receive a threaded sighting pin 24, threaded along most of its length. Bores 23 in receiving blocks 18 are aligned with a slot 25 in mounting block 10 that passes completely through block 10 and intersects with groove 17 so that sighting pins 24 mounted in bore 23 pass through slot 24 on either side of mounting block 18. Rotation of sighting pins 24 cause them to move through bore 23, the direction of rotation determining the direction of movement of the pin with respect to its receiving block 18. One end of sighting pins 24 will narrow to a ball 26 which serves as the point which is lined up with the target when shooting. Each ball 26 will preferably be of a different color.

Figure 3:
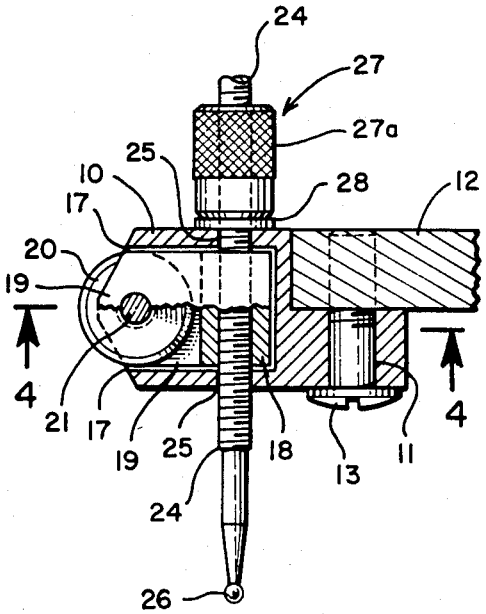

Each sighting pin 24 preferably has threadedly disposed thereon at the end opposite the sighting ball 26, a collar 27. A washer 28 is positioned between collar 27 and mounting block 10. Both the washer and the collar have a diameter greater than the width of the slot 25. Thus, when collar 27 is screwed along the sighting pin 24 to compress washer 28 tightly against the mounting block 10, the sighting pin will be locked against rotation, and the pin, with its receiving block 18, will also be locked in vertical position. A portion of collar 27, as shown at **27*a*, FIG. 3**, may be knurled to make it easier to hand tighten the collar.

A protective guard 30, FIG. 1, is mounted by nuts 31 to mounting block 10 to protect the sighting ends of sighting pins 24 during transportation and storage of the bow.

In use, once the sight is mounted to the handle section of a bow, the distance of the mounting block in front of the handle is set by sliding base member 12 within bracket 15. Screw 32 is tightened to secure base member 12 to bracket 15. Three predetermined positions are setable by placing screw 32 in one of the three holes 33 in base member 12 and tightening screw 32 to mate with a receiving hole, not shown, provided in mounting bracket 15. Intermediate positions are also setable as long as screw 32 is over bracket 15. The vertical position of mounting block 10 is adjusted by loosening screws 13 and sliding block 10 vertically in relation to base member 12 with screws 13 sliding in slot 11. When in desired position, screws 13 are tightened to secure block 10 to base member 12.

Once the position of mounting block 10 on the bow is set, the individual sighting pins are set in their vertical positions. This is done by turning the appropriate thumb wheels 20 to cause the respective sighting pins to move vertically within block 10. The verical setting of the pins is made for range distance with the lower pins generally being for the longer distance since sighting using the lower pins will require the archer to angle the bow higher, thus shooting the arrow at a higher angle. The uppermost pin is set for the shortest desired distance and the lowermost pin for the greatest desired distance. This sets the ranges within which the sight can be acurately used. The pins in between will be set for known intervals between these distances. The windage setting is made by rotating the sighting pin 24 within its receiving block 18 to move the pin horizontally with respect to the bow handle section. Once a pin is in the desired location, collar 27 is tightened against block 10 with washer 28 between to securely hold the pin in position against accidental rotation of the thumbscrew 20. However, even without collar 27 tightened to lock each pin 24 in place, the pins remain in position and do not move vertically unless the appropriate thumbscrew is rotated. Thus, whenever set by the thumbscrew, the pin will remain in that position until futher set by movement of the thumbscrew. This arrangement allows accurate setting of the sighting pins because the initial position is maintained and a fine adjustment from that position can be made by use of the thumbscrew.

While five sighting pins and five sighting pin receiving blocks are shown, the number of blocks provided and the number of pins acutally used up to the number of receiving blocks provided may vary.

Whereas this invention is here illustrated and described with specific reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

What is claimed is:

1. An archery bow sight, comprising a plurality of elongate sighting pins; a plurality of sighting pin receiving and holding means; a mounting block; a longitudinal groove in said mounting block that receives the plurality of sighting pin receiving and holding means for sliding movement therealong, said groove defining a path of travel for said plurality of sighting pin receiving and holding means; a threaded shaft extending along the length of said groove; mating thumbwheel means mounted in respective sighting pin receiving and holding means whereby rotational movement of a thumbwheel by a user imparts longitudinal movement to the respective pin receiving and holding means for moving respective sighting pin receiving and holding means back-and-forth along said path of travel and for maintaining the position of said individual receiving and holding means at any position along said path when operation of the means for moving ceases; and means for mounting the sight on an archery bow.

2. An archery bow sight according to claim 1, wherein the mounting block also includes a longitudinal slot therethrough intersecting said groove and wherein the sighting pins pass freeely through said slot.

3. An archery bow sight according to claim 2, wherein the respective sighting pins are threaded along a portion of their length and are received by a mating threaded bore through respective sighting pin receiving and holding means whereby rotation of a sighting pin within said bore causes movement of said pin with respect to its respective receiving and holding means.

4. An archery bow sight according to claim 3, wherein the means for mounting the sight on an archery bow is adapted to hold the mounting block in a position so that the longitudinal groove extends in the plane of the bow and movement of the pin receiving and holding means is along said plane and wherein the sighting pins are received by and held by said pin receiving and holding means so that their longitudinal axes are transverse to the plane of the bow.

5. An archery bow sight according to claim 3, wherein locking collar means are threaded onto the threaded portion of respective sighting pins and are adapted to be tightened against the mounting block to thereby the lock the sighting pins in preset position with respect to said mounting block.

6. An archery bow sight according to claim 5, wherein a washer is positioned between the collar and the mounting block.

7. An archery bow sight according to claim 1, wherein the sighting pin receiving and holding means includes a pair of parallelly extending ears and wherein the thumbwheel means is positioned between said ears.

8. An archery bow sight according to claim 1, wherein the respective sighting pins are threaded along a portion of their length and are received by a mating threaded bore through respective sighting pin receiving and holding means whereby rotation of a sighting pin within said bore causes movement of said pin with respect to its respective receiving and holding means.

9. An archery bow sight according to claim 1, wherein the means for mounting the sight of an archery bow is adapted to hold the mounting block in a position so that the path of travel extends in the plane of the bow and movement of the pin receiving and holding means is along said plane and wherein the sighting pins are received by and held by said pin receiving and holding means so that their longitudinal axes are transverse to the plane of the bow.

* * * * *